United States Patent [19]

Nicyper

[11] 4,397,090

[45] Aug. 9, 1983

[54] REPROPORTIONING GRAPHICAL PANTOGRAPH

[76] Inventor: Raymond Nicyper, 73 Birch Hill Ext., Weston, Conn. 06883

[21] Appl. No.: 306,704

[22] Filed: Sep. 29, 1981

[51] Int. Cl.[3] ..... B43L 13/10

[52] U.S. Cl. ..... 33/25 R; 33/23 D

[58] Field of Search ..... 33/1 K, 23 R, 23 D, 33/23 E, 23 J, 25 R, 25 B, 25 C, 25 D, 25 E, 452, 456, DIG. 9

[56] References Cited

U.S. PATENT DOCUMENTS

| | | | |
|---|---|---|---|
| 364,043 | 5/1887 | Riche | 33/25 R |
| 2,734,271 | 2/1956 | Moriarty | 33/25 R |
| 2,885,786 | 5/1959 | Badgett | 33/23 R |
| 3,184,850 | 5/1965 | Muller | 33/25 B |
| 3,555,686 | 1/1971 | Hatem | 33/23 D |

FOREIGN PATENT DOCUMENTS

| | | | |
|---|---|---|---|
| 70102 | 6/1952 | Netherlands | 33/23 R |
| 572388 | 10/1977 | U.S.S.R. | 33/25 R |

*Primary Examiner*—Richard R. Stearns
*Attorney, Agent, or Firm*—Michael J. Striker

[57] ABSTRACT

A graphical pantograph having four pivotable bars and a guide track in which two guide pins slide. The pantograph is provided with a tracer pin and a marker pin which extend through a common plane. The guide pins and the tracer and marker pins can be interchangeably placed at the pivots of two neighboring bars or at any free ends of the bars so as to reproportion the image to be reproduced in any desired ratio and angle.

15 Claims, 11 Drawing Figures

REPROPORTIONING GRAPHICAL PANTOGRAPH

BACKGROUND OF THE INVENTION

The present invention relates to graphical image reproducing arrangements, and more particularly to image reproducing pantographs.

The commonly known pantographs include four bars pivotally interconnected with each other and forming a parallelogram and a fulcrum which is securely fastened to an edge of the drawing board or table. The conventional pantographs are able to reduce, enlarge or reproduce pictures, drawings, maps etc. The known arrangements of the type under consideration fail, however to reproportion an original image either by condensing or expanding or reversing the images to be reproduced.

SUMMARY OF THE INVENTION

It is therefore an object of the present invention to provide an improved graphical pantograph. More particularly, an object of the invention is to provide a pantograph which is able to reproportion an original image.

Another object of the invention is to provide a pantograph which is able to simultaneously reverse and reproportion images.

Still another object of the invention is to provide a pantograph which allows recreating a graphic image with a predetermined forward or backward slant.

These and other objects are attained by a pantograph for graphically reproducing images, comprising at least one guide track; four elongated bars having free ends and connecting points at which the respective bars are connected to each other; two guide pins on said bars adapted to slide along said track; a tracer on said bars for tracing an original image; a marker on said bars for graphically reproducing a required image; at least two intersecting elements slidable along said bars for defining proportions of the image to be reproduced, said tracer and said marker being so positioned on said bars that they extend through a common plane; said guide pins, said tracer and said marker being interchangeably positioned on said free ends and connecting points to thereby reproportion images by condensing or expanding, or reversing or inclining images in any desired direction.

Pivots may be mounted at the connecting points of the bars.

The tracer and the marker may be interchangeably positioned at one of the connecting points and at the free end of one of said bars.

The pantograph may include two guide tracks, each of said two guide pins being positioned in the respective track.

The tracks may be laterally spaced from each other in parallel relationship. In this case the tracer and the marker may also be interchangeably positioned at one of the connecting points and at the free end of one of the bars.

The tracks may extend parallel to each other and arranged in a partially overlapped relationship. In such modification the two guide pins may be located at the connecting points whereas the tracer and the marker may be positioned at the free ends of the respective bars.

The guide tracks may be spaced from each other in a longitudinal direction. In this modification the tracer and the marker can be interchangeably positioned at one of the connecting points and at the free end of one of said bars.

The pantograph can be adapted for reproducing oblique images.

The tracer and the marker may be interchangeably positioned at the connecting points.

The guide tracks may be arranged in a laterally abutting position.

The pantograph according to the invention is able to reduce or expand original images with ratio scales determinable and expressed in fractions, percentage, reciprocal fractions and percentage, plane incline angle, and projection interval angle.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF PREFERRED EMBODIMENTS

Figure 1:
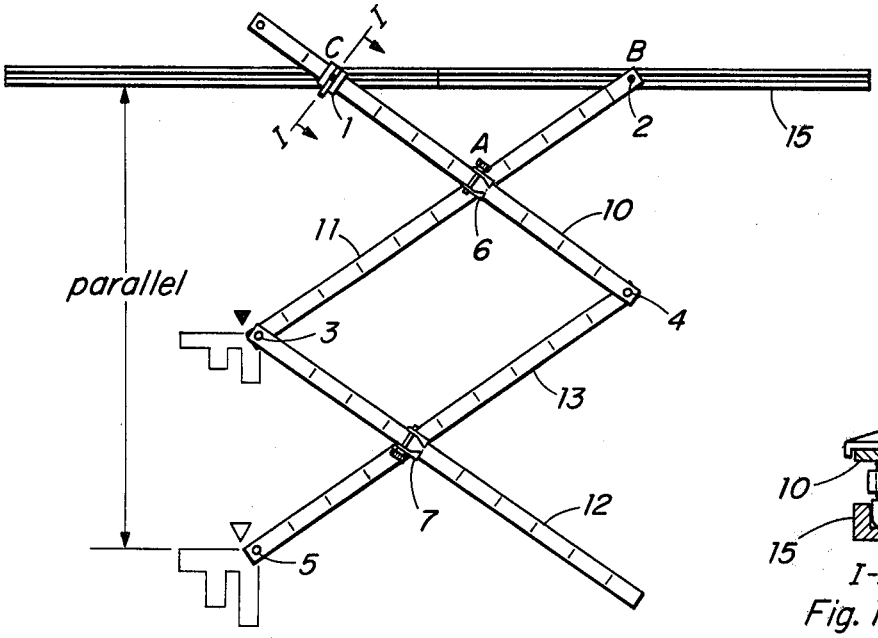
FIG. 1 is a schematic view of a pantograph having a single track and adapted to reproportion a reproduced image, in accordance with the invention.

Referring to the drawings and first to FIG. 1, a pantograph according to the invention includes four elongated bars 10, 11, 12 and 13 and a guide track 15. Bars 10 and 11 are terminated with guide pins secured to the free ends 1 and 2 of bars 10 and 11 and adapted to slide along the track 15 during reproducing of the image. Each two adjacent bars 10, 13 and 11, 12 are respectively interconnected by pivot axles at points 4 and 3. Each two intersecting bars 10, 11 and 12, 13 are respectively connected to each other by slidably adjustable elements 6 and 7 which can be set on the bars in accordance with required dimensions. Pivot axles can also be changed on certain pantograph arrangements by resetting pivot pins through a series of holes which may be formed in the bars.

Figure 1A:
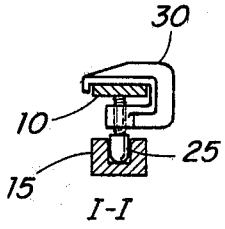
FIG. 1*a* is a sectional view along line I—I of FIG. 1.

FIG. 1*a* illustrates a cross-section view which shows in detail a connection between bar 10, a guide pin 25, track 15 and a clamp denoted as 30. Clamp 30 surrounding lateral sides of the bar 10 supports a guide pin 25 whose end is extended therefrom and received in the track 15. Pin 25 is screwed into a threaded hole formed in the clamp 30.

The four bars 10–13 following conventional pantograph procedure, are set with identical scale readings at the points defined by elements 6 and 7.

For the sake of convenience a tracer point will be denoted as a light triangle and a marker point as a dark triangle. Guide pin locations will be denoted as solid dark circles.

In order to reproportion an image which is designated by capital "F" the guide pins 25 for tracking are affixed at the ends of the corresponding bars 10 and 11 and are guided in a single track 15. Point 3 (dark triangle) represents a marker point and point 5 (light triangle) represents a tracer. With tracer point at 5, and marker at pivot 3, image is condensed in one dimension. With tracer point at pivot 3 and marker point at 5 image is expanded in one dimension. Proportions are changed by setting bar-intersecting elements 6 and 7 according to the calibrated scales on the bars. As can be clearly seen in FIG. 2 the tracer and marker pins are positioned on a common side of the pantograph and are in aligned position.

The adjustable clamp 30 holding the pivotal guide pin 25 and located at the point 1 is set on pantograph bar 10 with a distance A-C equal to the distance A-B where "A" defines the position of the intersecting member 6, "C" defines the position of point 1 and "B" defines the position of point 2 at which the guide pin of the bar 11 is located. Respective tracer pin and marker pin are attached to the bars at tracer and marker points.

Figure 2:
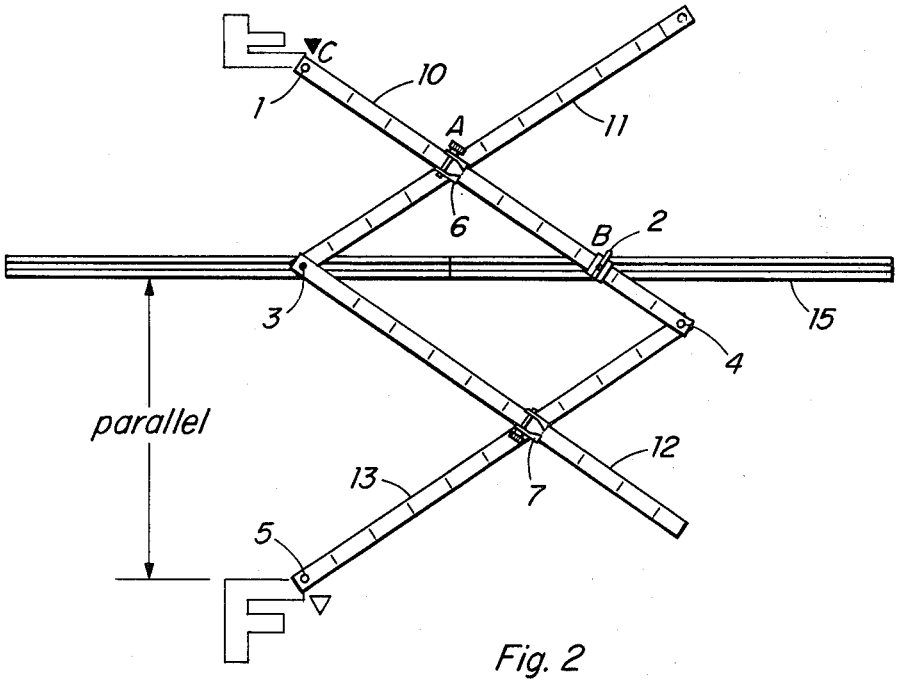
FIG. 2 is a schematic view of the pantograph of FIG. 1 but arranged for reproducing a reverse image.

Referring to FIG. 2 one guide pin for tracking is now affixed at point 3 and the other guide pin is affixed to the bar 10 between the pivot point 4 and the intersecting element 6, and tracer and marker points in turn are mounted at points 1 and 5 which, of course, can be interchangeable. Scale setting of intersecting elements 6 and 7 determines whether traced image is condensed, remains the same size, or expanded. FIG. 2 illustrates the position of the pantograph which is set to reverse the traced image.

Scales on all four pantograph bars are calibrated, and identical ratio markings are shown at intersecting elements 6 and 7.

Conversion scales are provided to enable determination of proportions in fractions, or percentages or degrees. Similar conversion scales are provided for setting mode to reverse images whether condensed, expanded or same size.

Original image should be parallel or perpendicular to the track 15 for a reproportioned image to be practically measurable.

FIGS. 3–10 illustrate the modifications of the pantograph of the invention in which two guide tracks are utilized for obtaining different kinds of reproportioning of the image to be reproduced.

Figure 3:
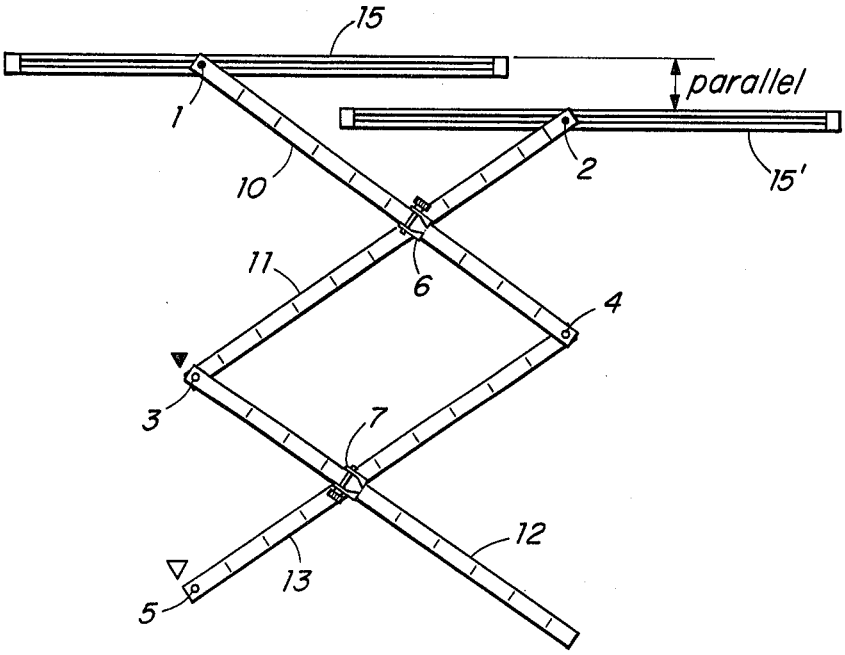
FIGS. 3 and 4 are schematic views of the pantographs with two parallel tracks spaced from one another.

As seen in FIG. 3, guide tracks 15 and 15' extend parallel to each other and positioned in a spaced relationship with one another. The guide pins 1 and 2 are positioned for sliding in two respective parallel tracks 15 and 15'; a tracer pin is positioned at 5 and a marker pin is placed at pivot 3. FIG. 3 illustrates a reproportion where a reproduced image is condenced.

Figure 4:
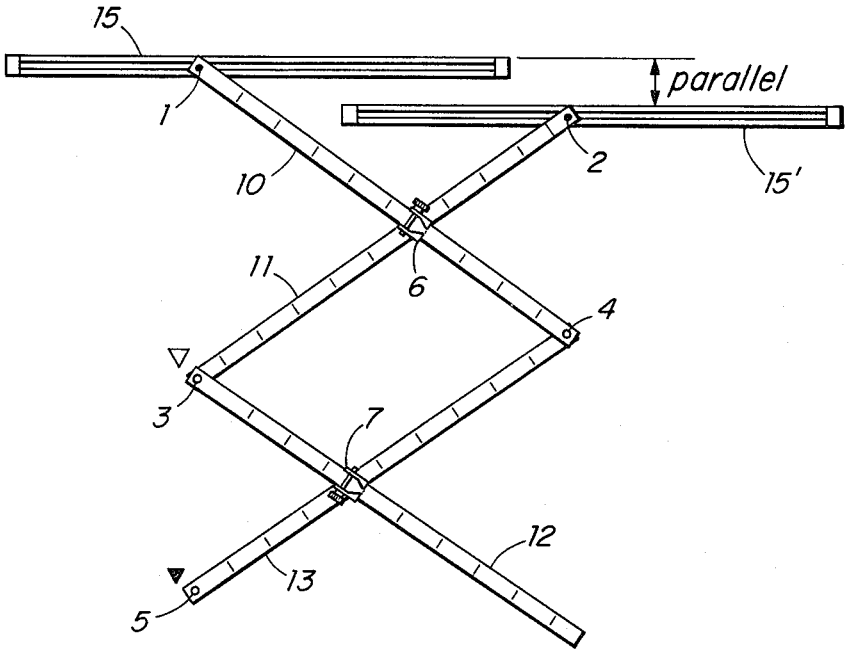

FIG. 4 shows an arrangement similar to that illustrated in FIG. 3 but set for expanding the image to be reproduced. For this purpose the tracer pin is positioned at pivot 3 and the marker pin is applied at the free end of the bar 13, namely at point 5. The movement of the tracer pin moves in a direction determined by the form of the original image. It is to be understood that the pantograph in each individual case is adjusted by placing elements 6 and 7 to required positions in accordance with the scales provided on bars 10–13.

Figure 5:
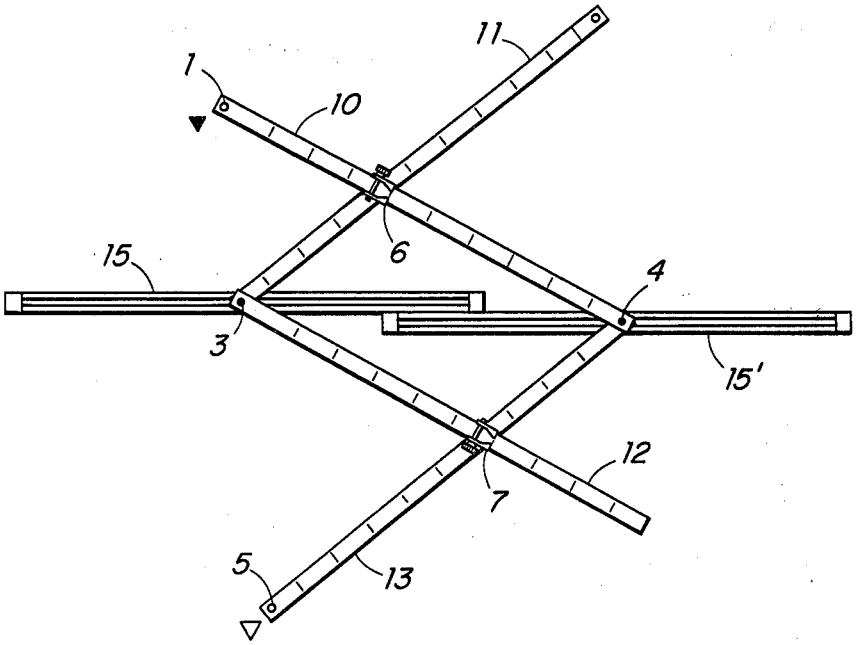
FIGS. 5 and 6 are schematic views of the pantographs with two adjacent parallel tracks.

FIG. 5 illustrates a further capability of the pantograph in accordance with the invention. Two parallel tracks 15 and 15' are arranged in this modified mode in a juxtaposed relationship.

The guide pins are affixed to pivot points 3 and 4. Guide pin at 3 slides along track 15 whereas guide pin at 4 is guided in track 15'. The tracer pin is now located at point 5 and the marker pin is positioned at point 1. A reversed condensed, same size, or expanded image can be obtained in the arrangement shown in FIG. 5. Condensed image is shown.

Figure 6:
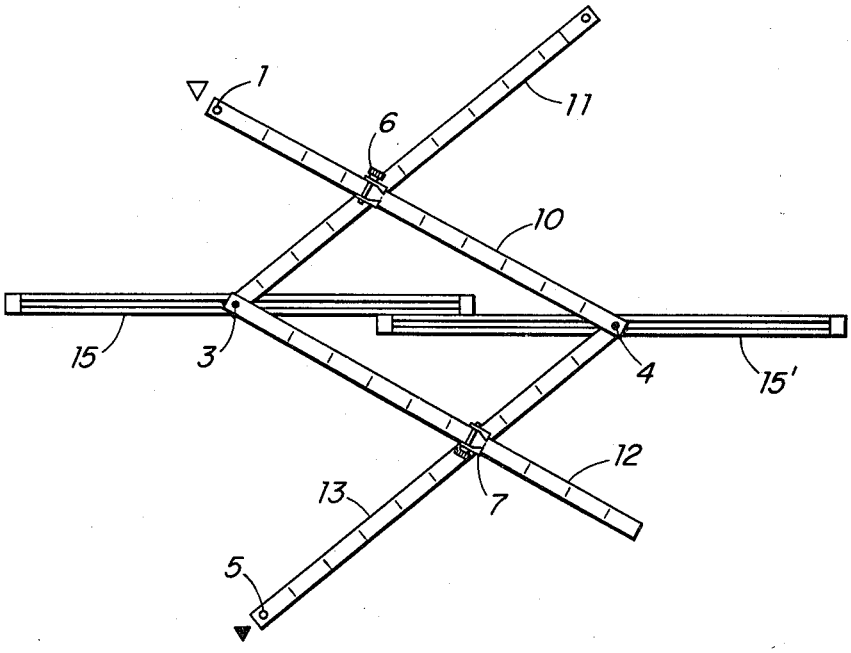

FIG. 6 shows the arrangement of FIG. 5, but in which guide pins are affixed at pivot points 3 and 4, and tracer pin is placed at the free end of bar 10 at point 1, whereas the marking pin is located at the free end of bar 13 at 5. A reversed expanded image is shown in the arrangement of FIG. 6.

Figure 7:
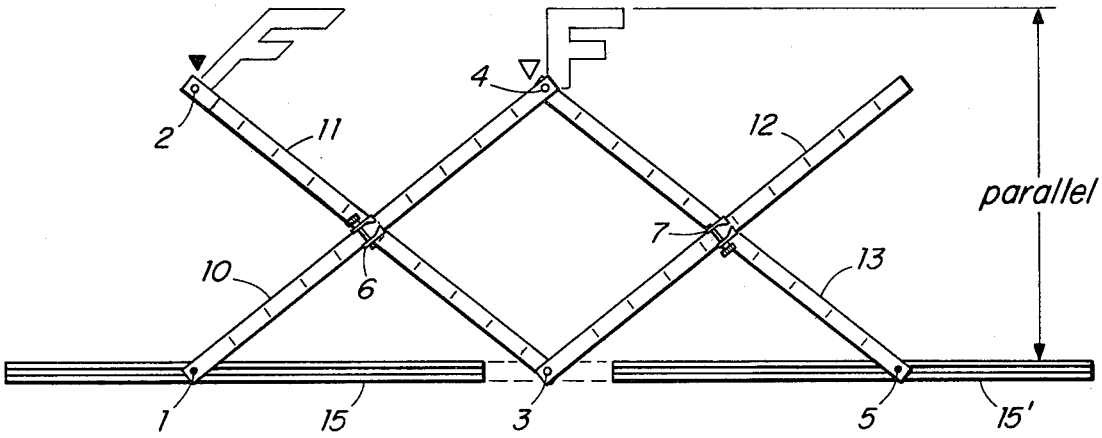
FIGS. 7 and 8 are schematic views of the pantographs with two spaced tracks for reproducing oblique images.
Figure 8:
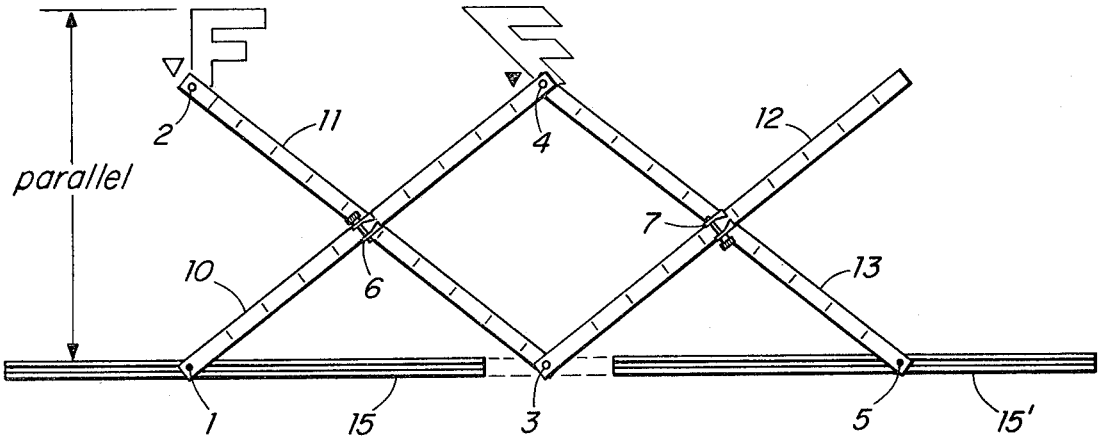

FIGS. 7 and 8 illustrate arrangements in which oblique images can be reproduced. By adjusting the intersecting elements 6 and 7 on the respective bars and by setting the guide pins in a predetermined manner angled images which are slanted forward or backward of original images can be obtained. Any desired angle of inclination of the images can be achieved.

FIG. 7 shows an oblique right mode of image recreation whereas FIG. 8 depicts an oblique left mode of image recreation. In FIG. 7 the guide pins are affixed to the respective free ends of bars 10 and 13 at points 1 and 5 and placed in two longitudinally spaced tracks 15 and 15'. The tracer pin is positioned at pivot 4 and the marker pin is applied to the free end of bar 11 at 2. In FIG. 8 the tracer pin is at the free end of bar 11 and the marker pin is at the pivot point 4.

Figure 9:
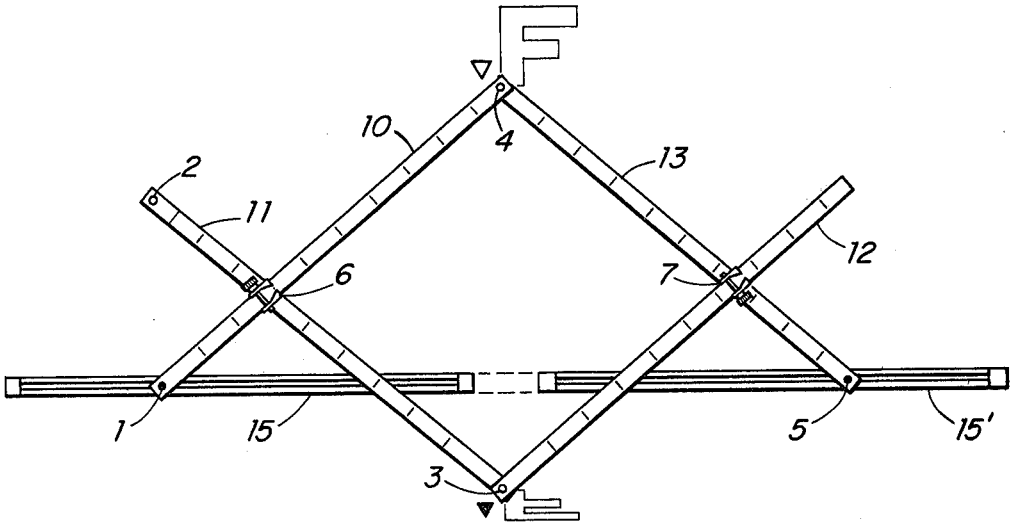
FIG. 9 is a schematic view of the further modification of the pantograph.

FIG. 9 shows a further embodiment of the pantograph. The arrangement shown in FIG. 9 is adapted for reproducing a reverse reproportioned condensed image but in this case each function requires a double set of conversion scales to set the pantograph for reproportioning. In FIG. 9 the guide pins are fixed to the free ends 1 and 5 placed in tracks 15 and 15', and the tracer pin is placed at the pivot point 4 whereas the marker pin is located at the pivot point 3.

Figure 10:
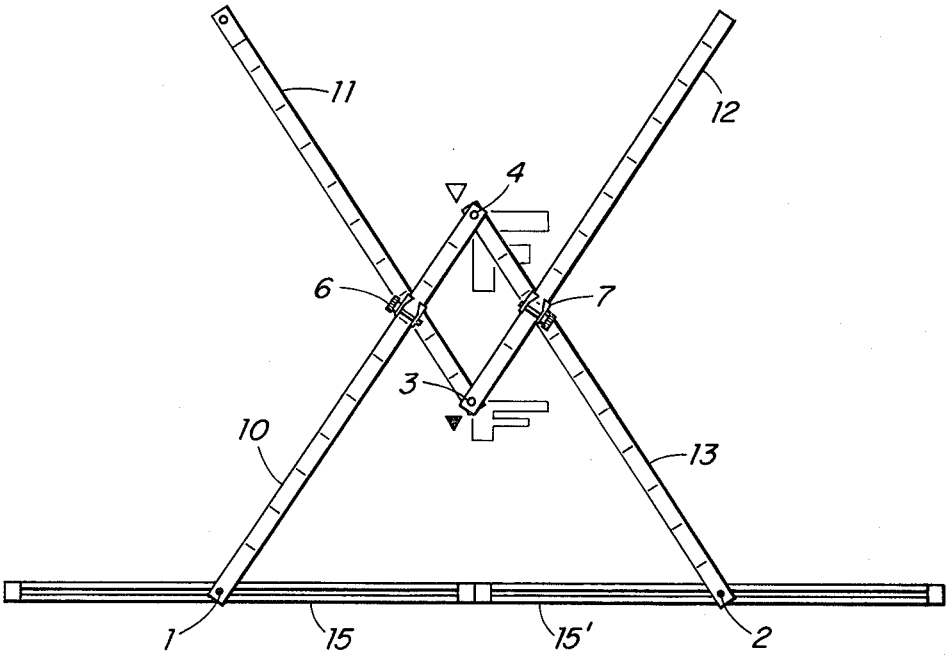
FIG. 10 is a schematic view of a still further modification of the pantograph.

FIG. 10 illustrates the arrangement in which a straight condensed reproportioning can be produced. The tracks 15 and 15' abut one against another. The tracer pin and the marker pin are located at two opposite pivot points 4 and 3 and the guide pins are positioned at the respective free ends of two adjacent bars 10 and 13.

The operation of any tracing mode requires software conversion scales for accurately setting the pantograph to create calculated reproportioned images. The only reproportioning function requiring the original image to be placed at a 45° angle is the one for reproducing the image to a given projection interval angle. For all other functional modes, the original image is placed 0° to the guide tracks.

It is to be noted that in all cases the tracer pin and the marker pin extend through a common plane.

The pantograph according to the invention traces graphics while maintaining unity in one dimension and controlling reproportioning in the second dimension.

It will be understood that each of the elements described above, or two or more together, may also find a useful application in other types of graphic pantographs differing from the types described above.

While the invention has been illustrated and described as embodied in a graphic pantograph, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A pantograph for graphically reproducing images, comprising at least one guide track; four elongated bars having free ends and connecting points at which the respective bars are pivotally connected to each other; two guide pins on said bars adapted to slide along said track; a tracer on said bars for tracing an original image; a marker on said bars for graphically reproducing a required image; at least two intersecting elements, each being slidable and selectively positionable along two of said bars and permitting relative pivotal movement between the associated two bars for defining proportions of the image to be reproduced, said tracer and said marker being so positioned on said bars that they extend through a common plane; said guide pins, said tracer and said marker being interchangeably positionable at said free ends and at said connecting points to thereby reproportion images by condensing, expanding, or reversing, or inclining images in any desired direction.

2. The pantograph of claim 1, wherein pivots are mounted at said connecting points of said bars.

3. The pantograph of claim 2, wherein said tracer and said marker are interchangeably positioned at one of said connecting points and at a free end of one of said bars.

4. The pantograph of claim 2, wherein said guide pins are positioned at said connecting points.

5. The pantograph of claim 2, including a clamping element on at least one of said bars for holding at least one of said guide pins, said clamping element being adapted to slide along said one bar and be clamped thereon in a predetermined position.

6. The pantograph of claim 2, including two guide tracks, each of said two guide pins being positioned in the respective track.

7. The pantograph of claim 6, wherein said tracks are laterally spaced from each other in parallel relationship.

8. The pantograph of claim 7, wherein said tracer and said marker are interchangeably positioned at one of said connecting points and at the free end of one of said bars.

9. The pantograph of claim 6, wherein said tracks extend parallel to each other and arranged in a partially overlapped relationship.

10. The pantograph of claim 9, wherein said two guide pins are located at said connecting points, said tracer and marker being positioned at the free ends of said respective bars.

11. The pantograph of claim 6, wherein said two guide tracks are spaced from each other in a longitudinal direction.

12. The pantograph of claim 11, wherein said tracer and said marker are interchangeably positioned at one of said connecting points and at the free end of one of said bars, the pantograph being arranged for reproducing oblique images.

13. The pantograph of claim 6, wherein said guide tracks are in a laterally abutting position.

14. The pantograph of claim 13, wherein said tracer and said marker are interchangeably positioned at said connecting points, respectively.

15. The pantograph of claim 1, wherein said tracer and said marker extend a common plane located on a common side of the pantograph.

* * * * *